US005080372A

United States Patent [19]

Brine, III et al.

[11] Patent Number: 5,080,372

[45] Date of Patent: Jan. 14, 1992

[54] LACROSSE STICK HEAD WITH INWARDLY EXTENDING SIDE RIB MEANS

[75] Inventors: William H. Brine, III, Mendon, Mass.; Peter J. Brine, Hanover, N.H.; Klon R. Ervin, Glen Arm, Md.

[73] Assignee: Sports Licensing, Inc., Hanover, Mass.

[21] Appl. No.: 627,326

[22] Filed: Dec. 14, 1990

[51] Int. Cl.[5] ..... A63B 59/02

[52] U.S. Cl. ..... 273/326

[58] Field of Search ..... 273/326

[56] References Cited

U.S. PATENT DOCUMENTS 2,508,519 5/1950 Jay ..... 273/326

3,910,578 10/1975 Brine, Jr. ..... 273/96 D 4,153,251 5/1979 Pond ..... 273/326

4,657,260 4/1987 Brine, Jr. ..... 273/326

4,861,042 8/1989 Trettin ..... 273/326

*Primary Examiner*—William H. Grieb

*Attorney, Agent, or Firm*—Lorusso & Loud

[57] ABSTRACT

A lacrosse stick head comprising a frame and netting attached to the frame, the frame comprising a throat portion, a side wall extending from the throat portion, and a lip portion joined to an end of the side wall remote from the throat portion, the netting being configured to define a ball pocket, and a rib on interior wall portions of the side wall and extending inwardly to overlie marginal portions of the netting.

6 Claims, 4 Drawing Sheets

LACROSSE STICK HEAD WITH INWARDLY EXTENDING SIDE RIB MEANS

BACKGROUND OF THE INVENTION

1. Field of the Invention

This invention relates to lacrosse sticks and is directed more particularly to a lacrosse stick head having side wall stiffening and ball retaining means therein.

2. Description of the Prior Art

Lacrosse sticks include head portions attached to stick handles. The head portion comprises a frame which includes a throat portion, side wall means, and a lip portion. Interiorly of the frame there is disposed a netting which includes a ball pocket.

The frames of lacrosse stick heads are commonly made from plastic materials affording lightness and toughness to the frame. However, a problem that causes some concern in plastic frames is a lack of rigidity in the side to side dimension. Because of weight limitations, manufacturers are unable to compensate by simply substantially increasing the thickness of the frame walls.

In attempts to provide added rigidity to the frame, flanges have been molded on the outer walls of the frames. U.S. Pat. No. 4,657,260, issued Apr. 14, 1987 in the name of William H. Brine, Jr. illustrates several embodiments of frame side walls provided with flanges on their outer surfaces. While such flanges have improved rigidity, they unfortunately clutter up an otherwise smooth surface adapted for the display of manufacturer's logos and/or team symbols.

Another concern of lacrosse players is the facility of the lacrosse stick head to assist in retention of a ball therein. In U.S. Pat. No. 3,910,578, issued Oct. 7, 1975 in the name of William H. Brine, Jr., there is illustrated the provision of side walls curved with an inboard concavity which assists in keeping a ball in the ball pocket. However, plastic frames are molded and the provision of molds for producing walls with curved surfaces, particularly interior surfaces, requires relatively expensive mold-making techniques and the use of a plurality of mold inserts.

In U.S. patent application Ser. No. 07/628,193, filed Dec. 14, 1990, in the names of Joseph Taylor, William H. Brine, III and Peter J. Brine there is shown and described a new concept in lacrosse stick heads in which the ball pocket is located not in the traditional area, the throat, but forwardly of the throat. Thus, in the use of such sticks, it is beneficial to have a ball retention facility in the side wall area, rather than in the throat area of the head.

Accordingly, an improvement in the construction of lacrosse stick frames which adds rigidity to the frame, provides a ball retention facility, and is suitable for a forward ball pocket location, is deemed beneficial by the lacrosse community.

SUMMARY OF THE INVENTION

It is, therefore, an object of the invention to provide a lacrosse stick head having on side wall means thereof rib means extending inwardly and overlying marginal portions of the netting, the rib means being adapted to facilitate easier retention of a ball in the netting of the head forward of the throat.

A further object of the invention is to provide a lacrosse stick head as described immediately above, wherein the rib means is further adapted to increase rigidity of the side wall means.

With the above and other objects in view, as will hereinafter appear, a feature of the present invention is the provision of a lacrosse stick head comprising a frame and netting attached to the frame, the frame comprising throat portion, side wall means extending from the throat portion, and a lip portion joined to an end of the side wall means remote from the throat portion, the netting being configured to define a ball pocket, and rib means on interior wall portions of the side wall means and extending inwardly so as to overlie portions of the netting proximate the ball pocket.

The above and other features of the invention, including various novel details of construction and combinations of parts, will now be more particularly described with reference to the accompanying drawings and pointed out in the claims. It will be understood that the particular device embodying the invention is shown by way of illustration only and not as a limitation of the invention. The principles and features of this invention may be employed in various and numerous embodiments without departing from the scope of the invention.

BRIEF DESCRIPTION OF THE DRAWINGS

Reference is made to the accompanying drawings in which is shown an illustrative embodiment of the invention, from which its novel features and advantages will be apparent.

In the drawings.

DESCRIPTION OF THE PREFERRED EMBODIMENT

Figure 1:
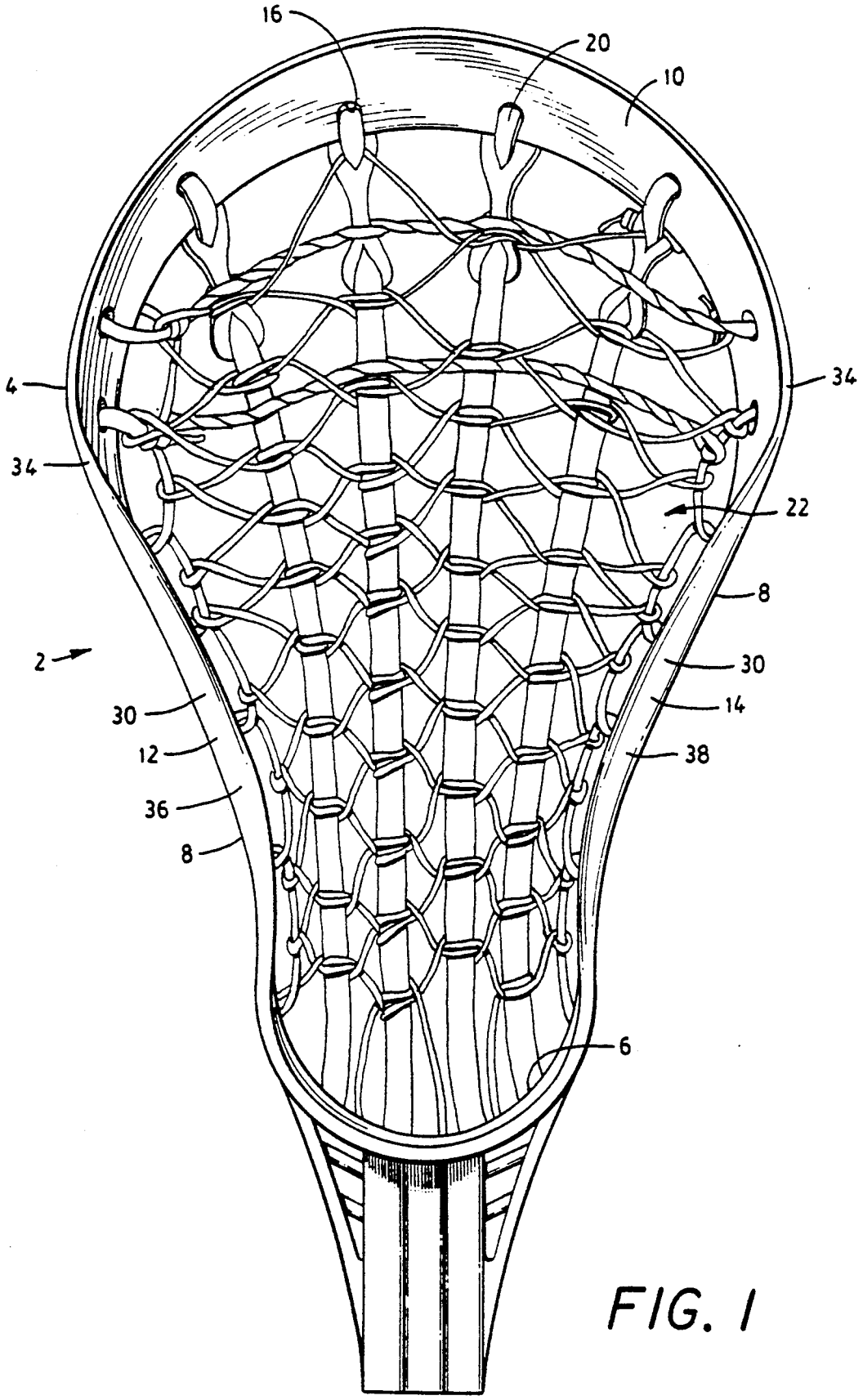
FIG. 1 is a top plan view of one form of lacrosse stick head illustrative of an embodiment of the invention.

Referring to the drawings, it will be seen that an illustrative lacrosse stick head portion 2 comprises a frame 4 which includes a throat portion 6 from which extend side wall means 8. A distal end of the side wall means 8 joins a lip portion 10. The side wall means 8 generally include two side walls 12, 14, as illustrated in FIG. 1, but may comprise only one side wall. The frame 4 may be of wood, but in recent times predominantly has been constructed of a substantially rigid lightweight plastic, such as a nylon, a polyurethane, or mixtures of thermoplastic polymers.

The throat portion 6, the side wall means 8 and the lip portion 10 are provided with holes 16 in which are disposed portions 18, 20, respectively, of a netting 22. The netting 22 is thus attached to, and retained by, the frame 4.

Figure 3:
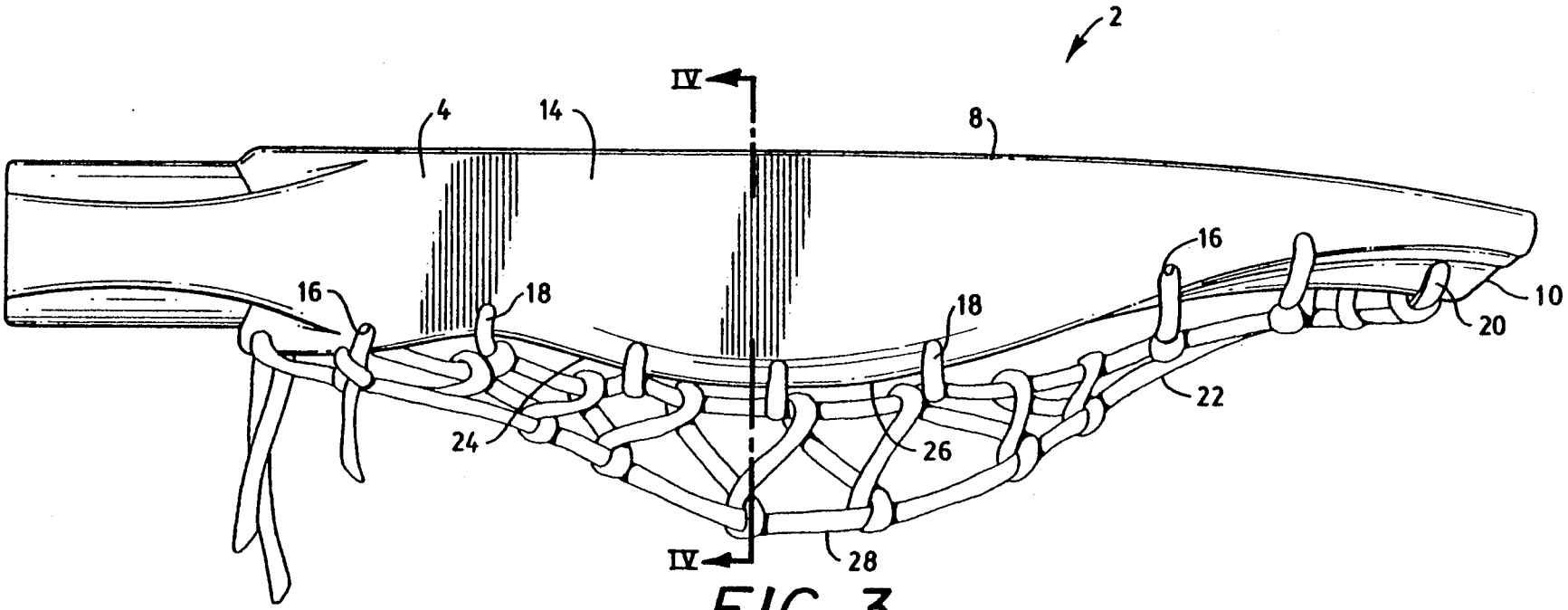
FIG. 3 is a side elevational view of the lacrosse stick head shown in FIGS. 1 and 2.
Figure 4:
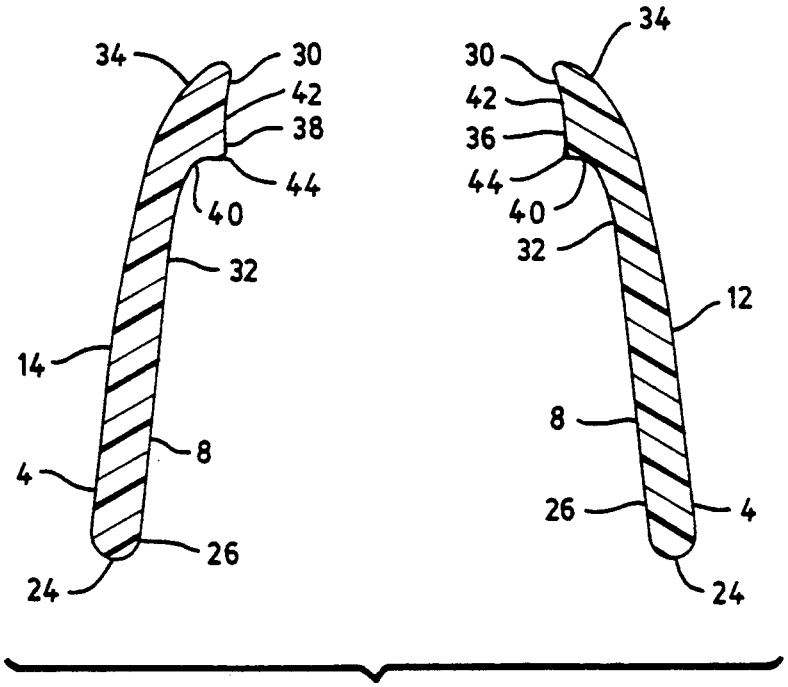
FIG. 4 is a sectional view of side wall portions taken along line IV—IV of FIG. 3.

Referring to FIG. 3, it will be seen that the side wall means 8 is characterized by a bottom edge thereof 24 which extends outwardly, edgewise, such as generally to define a bulge 26 in the bottom of the side wall means. The bulge 26 comprises an outward extension of the bottom edge 24, the bulge being substantially in the plane of the side wall (FIG. 4). The holes 16 in the side wall means 8 are each disposed proximate the bottom edge 24, enabling the netting to define a ball pocket 28 generally alongside and beneath the bulge 26, which is disposed about mid-length of the side wall means.

Figure 2:
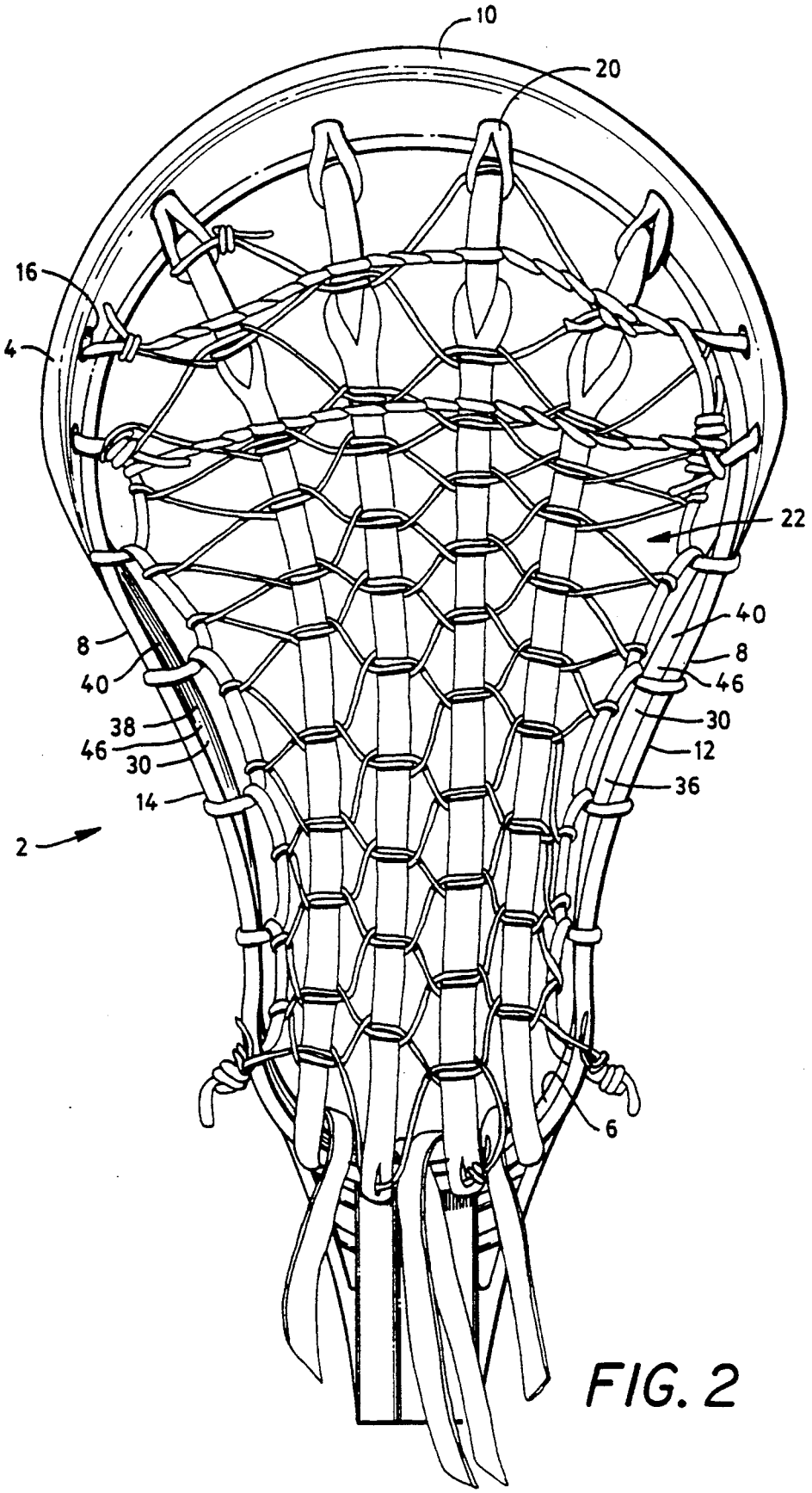
FIG. 2 is a bottom view thereof.

Each side wall 12, 14 of the side wall means 8 is provided with elongated rib means 30 on an interior surface 32 (FIG. 4) of the side wall and extending inwardly so as to overlie marginal portions of the netting (FIGS. 1 and 2). Preferably, the rib means is disposed, at least in part, proximate an upper edge 34 of the side wall, as may be seen in FIGS. 1 and 4. In the embodiments in which the side wall means 8 comprise the two side walls 12, 14, the rib means 30 comprise first and second rib means 36, 38 extending inwardly of the frame toward each other in a plane overlying the ball pocket 28, and overlying portions of the netting proximate the ball pocket 28. The rib means 36, 38 each comprise elongated protrusions projecting inwardly of the head portion from the interior surfaces 32 of their respective wall 12, 14, and substantially normal to the interior surfaces (FIG. 4), which need not be curved, thus simplifying the molding of the frame. Preferably, the rib means 30 are molded integrally with the side wall means 8.

Each of the ribs 36, 38 has a substantially flat undersurface 40 (FIGS. 2 and 4) generally normal to the interior surface 32 of the associated side wall 12, 14, and has an end surface 42 (FIG. 4) disposed inwardly of the interior surface 32. The end surface 42 and the undersurface 40 are generally normal to each other and at their juncture provide a ridge 44 (FIG. 4) inwardly of the interior surface 32 and disposed so as to overlie marginal portions of the netting 22. Each protrusion, at its ends, flairs into the interior surface 32 of its side wall 12, 14 (FIG. 2). A widest portion 46 of each rib undersurface 40, when viewed in plan, projects inwardly from the side wall bulge 26 area to overlie marginal portions of the ball pocket 28.

Thus, there is provided a lacrosse stick head frame in which the side wall means are given added rigidity by rib means, the rib means being disposed interiorly of the side wall means, leaving the exterior free for cosmetic purposes, and the rib means providing a head having a ball pocket forwardly of the throat area with a ball retention aid, by virtue of the rib means overlying netting in the vicinity of the ball pocket.

It is to be understood that the present invention is by no means limited to the particular construction herein disclosed and/or shown in the drawings, but also comprises any modifications or equivalents within the scope of the claims.

Having thus described our invention, what we claim as new and desire to secure by Letters Patent of the United States is:

1. A lacrosse stick head comprising a frame and netting attached to said frame, said frame comprising a throat portion, first and second side walls extending from said throat portion, and a lip portion joined to ends of said side walls remote from said throat portion, said netting being configured to define a ball pocket, and ribs on interior surfaces of said side walls, said ribs each comprising an elongated protrusion extending inwardly of said head, said protrusion projecting from said interior surface of one of said side walls and having a substantially flat undersurface generally normal to said interior surface of said side wall and having an end surface disposed inwardly of said interior surface of said side wall, said end surface and said undersurface being generally normal to each other whereby to provide a ridge at their juncture inwardly of the side wall interior surface and disposed so as to overlie marginal portions of said netting.

2. The lacrosse stick head in accordance with claim 1 wherein said ribs are disposed proximate upper edges, respectively, of said side walls.

3. The lacrosse stick head in accordance with claim 2 wherein said ribs in part define said upper edges of said side walls, and said frame is molded plastic material and said ribs are molded integrally with said side walls.

4. The lacrosse stick head in accordance with claim 1 wherein said ribs are disposed at least in part proximate upper edges of said side walls.

5. The lacrosse stick head in accordance with claim 1 wherein each of said elongated protrusions flairs into the interior surface of its respective side wall, a widest portion of said protrusion undersurface, viewed in plan, projecting inwardly from said side wall to overlie marginal portions of said ball pocket.

6. The lacrosse stick head in accordance with claim 5 wherein said side wall has a bottom edge extending outwardly edgewise so as generally to define a bulge in said bottom edge of said side wall generally in the plane of said side wall, said widest portion of said undersurface projecting from said side wall and being disposed in said side wall in an area over said bulge.

* * * * *